US005803631A

United States Patent [19]

Bingham et al.

[11] Patent Number: 5,803,631

[45] Date of Patent: Sep. 8, 1998

[54] PRINT MEDIA ALIGNMENT APPARATUS AND METHOD

[75] Inventors: Jeffrey Glen Bingham; Carl David Beckett; Craig Daniel Sunada, all of Vancouver, Wash.

[73] Assignee: Hewlett-Packard Company, Palo Alto, Calif.

[21] Appl. No.: 873,529

[22] Filed: Jun. 12, 1997

[51] Int. Cl.[6] ..... B41J 11/26

[52] U.S. Cl. ..... 400/624; 271/223; 271/213

[58] Field of Search ..... 400/625, 642, 400/647, 647.1; 271/223, 224, 121, 147, 213

[56] References Cited

U.S. PATENT DOCUMENTS

| | | | |
|---|---|---|---|
| 4,794,859 | 1/1989 | Huseby et al. | 101/485 |
| 5,152,622 | 10/1992 | Rasmussen et al. | 400/579 |
| 5,269,506 | 12/1993 | Olson et al. | 271/121 |
| 5,271,681 | 12/1993 | Otsuka et al. | 400/625 |
| 5,286,018 | 2/1994 | Rasmussen et al. | 271/147 |
| 5,299,875 | 4/1994 | Hock et al. | 400/625 |
| 5,324,020 | 6/1994 | Rasmussen et al. | 271/213 |
| 5,489,160 | 2/1996 | Patrick et al. | 400/642 |
| 5,527,123 | 6/1996 | Jackson et al. | 400/642 |

FOREIGN PATENT DOCUMENTS

| | | | |
|---|---|---|---|
| 000443590 A1 | 8/1991 | European Pat. Off. | 400/642 |
| 000532336A | 3/1993 | European Pat. Off. | 400/642 |
| 363242576A | 10/1988 | Japan | 400/642 |
| 403190770A | 8/1991 | Japan | 400/642 |
| 403293178 A | 12/1991 | Japan | 400/642 |

*Primary Examiner*—Eugene H. Eickholt
*Attorney, Agent, or Firm*—Erik A. Anderson

[57] ABSTRACT

A print media alignment apparatus is disclosed. An embodiment includes a first member configured to apply a varying force to at least one print media sheet of a print media stack. This force varies from a minimum below a first print media stack height to a maximum at a second print media stack height. The alignment apparatus also includes a second member configured to apply a constant force to the print media stack irrespective of the stack height. Another embodiment includes a print media width adjuster configured to be moveable adjacent a print media stack having at least one sheet of print media, the print media stack defining a plane. The alignment apparatus also includes a wall on the width adjuster. The wall includes a wall first print media contact surface configured to slope at an angle with respect to the plane. The alignment apparatus further includes a member attached to the width adjuster, the member including a member print media contact surface configured to be perpendicular to the plane. A method of aligning print media for use in a printing device is also disclosed. The method includes the steps of applying a varying first force to at least one sheet of print media at and above a first print media stack height and applying a second constant force to the print media irrespective of the print media stack height. The varying first force and the constant second force facilitate uniform alignment of the print media.

26 Claims, 4 Drawing Sheets

PRINT MEDIA ALIGNMENT APPARATUS AND METHOD

BACKGROUND AND SUMMARY

The present invention relates to a print media alignment apparatus for use in a printing device and to a method of aligning print media for use in a printing device.

Printing devices operate by printing on print media such as paper or transparencies. Historically, a continuous length of folded paper was pin-fed to a printing device by use of holes along edges of the length of paper. The pages with such paper were defined by perforations. Use of such continuous length paper increased efficiency over prior art printing devices which required each page to be hand-fed to the printing device. However, the finished printed product from continuous length paper printing devices required each page to be separated along the perforations defining each page and along the perforations defining the holed side regions used for pin-feeding to the printing device. This labor-intensive task resulted in printed pages with rough, perforated edges.

As a result, printing devices were developed in which a single top sheet of a print media stack is fed to a printing device. Such printing devices were an improvement over the prior art because the resulting printed page or sheet had no perforations along its edges. To maximize efficiency of single sheet printing devices, print media trays were developed to continuously feed single sheets of print media from the top of the print media stack to a printing device. Problems arise when two or more sheets are fed to a printing device simultaneously from such a tray. Multiple sheet intake leads to print media jams, print media slippage, print media waste, and to various other problems related to the print operation.

To alleviate such multiple sheet intake, stack feed printing devices often employ mechanisms adjacent input ports of the printing device which separate sheets of print media as they are taken into the printing device. For such separator mechanisms to function, the top sheet of a print media stack must be properly aligned for feeding into the input port of the printing device.

To facilitate print media alignment, an input tray having a guide rail and/or one or more datums perpendicular to the printing device input port is/are used. The print media stack is placed in the input tray with one edge of the print media stack placed against the guide rail and/or datums. For proper alignment and corresponding proper separator mechanism function, the top sheet of the print media stack must be aligned against the guide rail and/or datums prior to being feed into the printing device input port. A print media alignment device is used to exert a force on the print media stack to align the sheets properly against the guide rail and/or the input datums for feeding to the printing device.

The force required to properly align the to-be-fed top sheet of a print media stack varies with print media stack height due to impingement of the print media alignment device on multiple sheets of the print media stack at one time, with the print media stack height determining, at least in part, the mass of print media to be urged against the guide rail and/or datums. As the print media stack height decreases, this force must also decrease to prevent buckling of the print media.

Preferably, the input print media is exactly square on its edges and is referenced against the guide rail and/or datums when loaded in the input tray. However, due to inexact loading, or forces generated by the printing device during operation (e.g., print media picking skew or carriage acceleration and deceleration), the print media stack can be in a non-ideal position. When this happens, printing device performance is low with respect to top, side, and bottom squareness. Print media jams, slippage, and waste may also occur.

Previous print media alignment devices either provided a constant force on the print media stack or tried to accomplish a varying force using a single, spring biased, sloped tip on a width adjuster. These methods have proved only partially effective in delivering the range of forces required to bias an entire print media stack.

The present invention is directed to solving these problems. The present invention uses two members or walls, each of which provides different forces to various regions of a print media stack. The present invention uses a relatively high force, low deflecting member or wall to apply a larger force or bias when there is a larger print media stack. The force applied by this member or wall is largest at the top of the print media stack and, to avoid buckling of the print media stack, is decreased with decreasing print media stack height by use of a sloped wall or print media contact surface, which decreases deflection of the member or wall with print media stack height. The present invention also uses a relatively lower force, larger deflecting member or wall to provide a constant force that is large enough to bias or urge the print media stack against the guide rail and/or datums, while not causing a print media stack consisting of only a single sheet or a few sheets of print media to buckle. This relatively lower force, larger deflecting member or wall has a non-sloped print media contact surface which applies a constant force throughout the entire print media stack, actively working on biasing or moving the entire stack.

An embodiment of the present invention is a print media alignment apparatus for use in a printing device. The print media alignment device includes a first member coupled to the printing device and a second member also coupled to the printing device. The first member is configured to apply a varying force to at least one print media sheet of a print media stack. This force varies from a minimum below a first print media stack height to a maximum at a second print media stack height. The second member is configured to apply constant force to the print media stack irrespective of print media stack height.

The above-described print media alignment apparatus may include the following additional features and characteristics. The constant force applied by the second member to the print member stack may be less than the maximum force applied by the first member to the print media stack at the second print media stack height. The constant force applied by the second member to the print media stack may be greater than the minimum force applied by the first member. This varying force applied by the first member may decrease as the print media stack height decreases. This varying force applied to the print media stack by the first member may vary linearly between the first print media stack height and the second print media stack height. The varying force applied to the print media stack by the first member may vary in a stepwise manner from a minimum force below the first print media stack height to the maximum force at the second print media stack height. The first print media stack height may be 2 millimeters, the second print media stack height may be 8 millimeters, the maximum of the varying force applied by the first member may be 170 grams, and the constant force applied by the second member may be 30 grams.

The first member may include a wall having a print media contact surface configured to contact the print media stack at and above the first print media stack height. The first member may further include a force mechanism that biases the print media contact surface against the print media stack.

The second member may include a wall having a contact surface configured to engage the print media stack at all heights of the print media stack. The second member may further include a force mechanism that biases the print media contact surface against the print media stack.

Another embodiment of a print media alignment apparatus for use in a printing device in accordance with the present invention includes a print media width adjuster coupled to the printing device, a wall on the print media width adjuster, and a member attached to the print media width adjuster. The print media width adjuster is configured to be moveable adjacent a print media stack having at least one sheet of print media, the print media stack defining a plane. The wall includes a wall first print media contact surface configured to slope at an angle with respect to the plane. The member includes a member print media contact surface configured to be perpendicular to the plane.

The above-described print media alignment apparatus may include the following additional features and characteristics. The wall first print media contact surface may be configured to contact at least one sheet of the print media stack at and above a predetermined print media stack height. The member print media contact surface may be configured to contact the print media stack at all print media stack heights. The predetermined print media stack height may be 2 millimeters.

The wall may additionally include a wall second print media contact surface configured to be perpendicular to the plane and to lie adjacent the wall first print media contact surface. The wall may further include a wall third print media contact surface configured to be perpendicular to the plane and to lie adjacent the wall first print media contact surface.

The print media alignment apparatus may further include a force mechanism operatively coupled to the member to urge the member print media contact surface against the print media stack. The member may be pivotally attached to the print media width adjuster and the force mechanism may include a spring. The print media alignment apparatus may additionally include a force mechanism adjacent the wall, the force mechanism providing a bias force to the wall first print media contact surface. The wall first print media contact surface may be configured to slope at an acute angle with respect to the plane.

The present invention also relates to a method of aligning print media for use in a printing device, the print media having at least one sheet. The method includes the steps of applying a varying first force to at least one sheet of print media at and above a first print media stack height and applying a second constant force to the print media irrespective of the print media stack height. The varying first force and the constant second force facilitate uniform alignment of the print media.

Other objects, advantages, and novel features of the present invention will become apparent from the following detailed description of the invention when considered in conjunction with the accompanying drawings.

BRIEF DESCRIPTIONS OF THE DRAWINGS

DETAILED DESCRIPTION OF THE DRAWINGS

Figure 1:
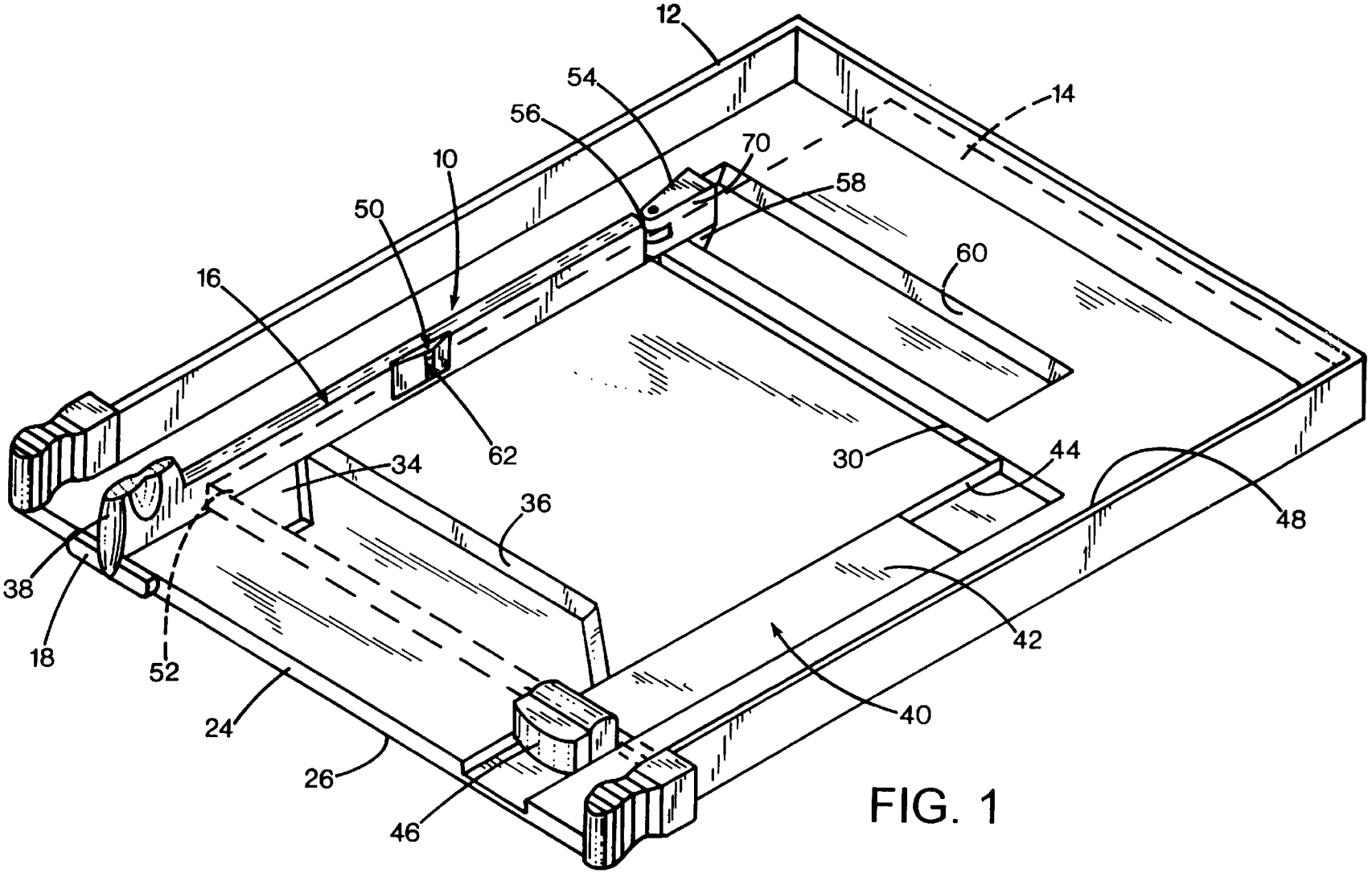
FIG. 1 is a top, perspective view of a preferred embodiment of a print media alignment apparatus in accordance with the present invention in a print media input tray of a printing device.

A preferred embodiment of a print media alignment apparatus 10 in accordance with the present invention is shown in FIG. 1 in a print media input tray 12 of a printing device (not shown), such as an inkjet printer. A print media stack 14 is shown in input tray 12 and includes one or more print media sheets, such as paper or transparencies. The height of print media stack 14 is determined by both the thickness and the number of such sheets.

Figure 2:
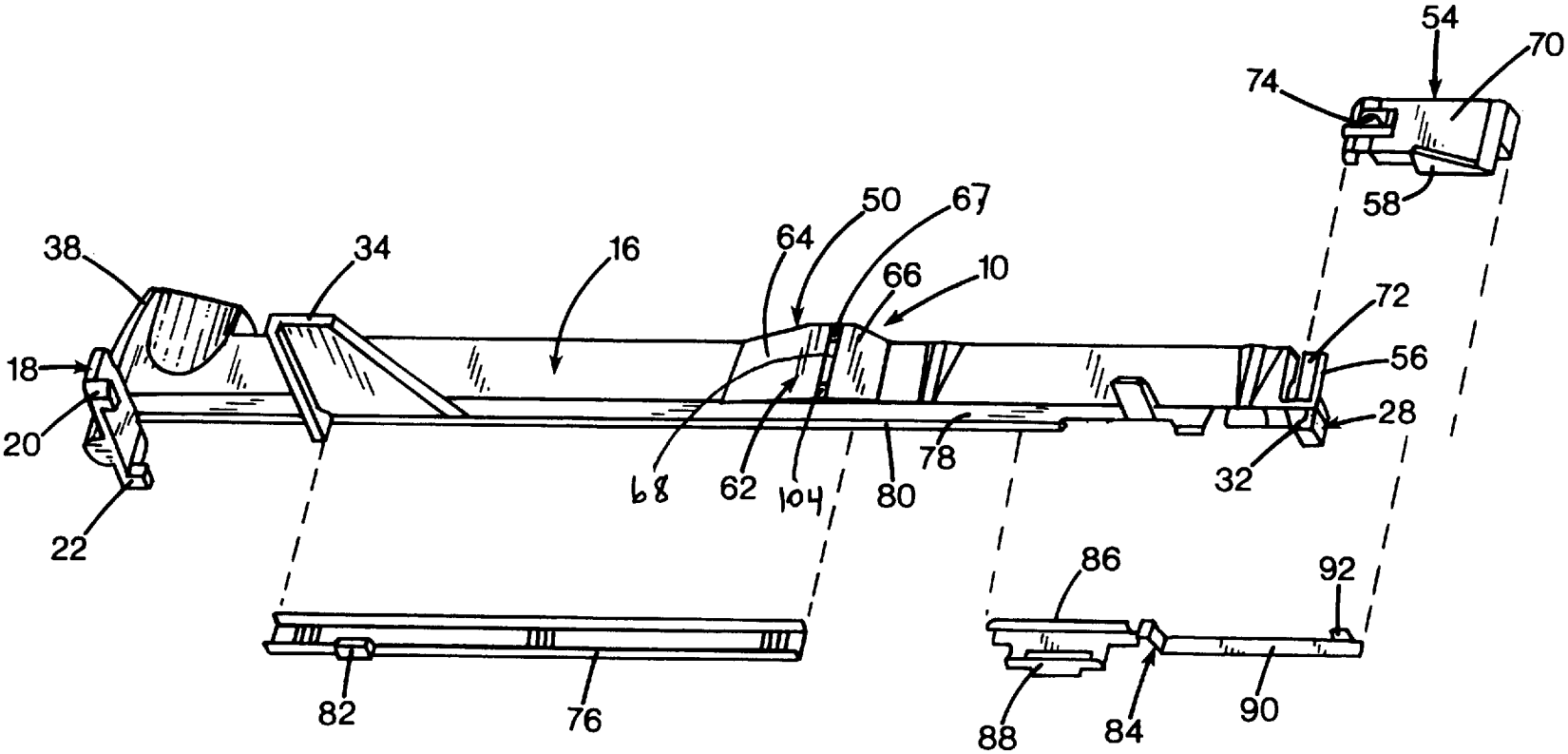
FIG. 2 is an exploded, bottom perspective view of the print media alignment apparatus shown in FIG. 1.

Print media width adjuster 16 is coupled to print media input tray 12 via a capture mechanism 18 that includes a pair of hooks 20 and 22, see FIG. 2, that engage an edge 24 and bottom 26, see FIG. 1, of print media input tray 12. Print media width adjuster 16 is also coupled to print media input tray 12 via a capture mechanism 28 which includes a hook 32, see FIG. 2, that is disposed in slot 30 of input tray 12, see FIG. 1, to engage bottom 26 of print media input tray 12. Width adjuster 16 includes a base member 34 disposed in track 36 and a handle 38 which allows width adjusters 16 to be manually moved adjacent print media stacks having different print media sheet widths.

Print media input tray 12 also includes a print media length adjuster 40 having a base member 42 disposed in a track 44. Length adjuster 40 additionally includes a handle 46 for manually moving length adjuster 40 adjacent print media stacks having different print media sheet lengths, as shown in FIG. 1.

Preferably, print media stack 14 is square or even on its edges and is referenced against side 48 of print media input tray 12 which may act as a guide rail and include one or more print media input tray datums (not shown). Print media width adjuster 16 and print media length adjuster 40 are supposed to facilitate this desired print media stack position. However, due to inexact loading by a user or forces generated by a printing device during operation (e.g., print media picking skew and carriage acceleration and deceleration), print media stack 14 can be in a non-ideal position. When this happens, printing device performance is low with respect to top, side, and bottom margin squareness on the individual print media sheets. An inexact alignment or squareness may also lead to multiple print media sheets being fed to a printing device simultaneously from input tray 12 which leads to problems such as print media jams, print media slippage, and waste of print media.

To ensure proper alignment of print media stack 14, a print media alignment apparatus, such as apparatus 10, must exert a bias force on print media stack 14 to properly align it against side 48 and any associated guide rails and/or datums. This alignment bias force varies with print media stack height due to impingement of the alignment device on multiple sheets of the print media stack at one time, with the print media stack height determining, at least in part, the mass of print media to be urged against side 48 and any associated guide rail and/or datums. As the print media stack height decreases, this bias force must also decrease to prevent buckling of the print media. Previous print media alignment devices either provided a constant force on the print media stack or tried to accomplish a varying force using a single, spring biased, sloped tip on a width adjuster. These methods have proved only partially effective in delivering the range of forces required to bias an entire print media stack.

Accordingly, the present invention is directed to a print media alignment apparatus 10 that applies a varying force to print media stack 14 dependent upon the height of the print media stack. Print media alignment apparatus 10 includes a first member 50 on print media width adjuster 16, as shown in FIGS. 1 and 2. Member 50 is configured to apply a varying force to at least one sheet of print media stack 14. This force varies from a minimum below a predetermined first print media stack height to a maximum at a second print media stack height, and is more fully discussed below. The force supplied by member 50 is largest at the top 52 of stack 14 and, to avoid buckling of print media stack 14, decreases with decreasing stack height, as more fully discussed below.

Apparatus 10 also includes a second member or wall 54 attached to an end 56 of print media width adjuster 16, as shown in FIGS. 1 and 2. Second member 54 is configured to apply a constant force to print media stack 14, irrespective of the height of print media stack 14. Second member 54 includes a base member 58 disposable in track 60 of print media input tray 12, as shown in FIG. 1, so as to be slideable with print media width adjuster 16 and base member 34, as width adjuster 16 is manually moved adjacent different print media stack widths.

As can be seen, for example, in FIG. 2, first member 50 of print media alignment apparatus 10 includes a wall 62 formed to include a first angled portion 64 and a second angled portion 66 that define a print media contact surface 68.

As can also be seen, for example, in FIG. 2, second member 54 includes a print media contact surface 70. Second member 54 is pivotally attached to end 56 of width adjuster 16 via a pivot post 72 formed on width adjuster 16, as shown in FIG. 2, which is received in slot 74 formed on second member 54. Print media width adjuster 16, member 50, and member 54 may be made from plastic or a hard elastomer.

As shown in FIG. 2, print media alignment apparatus 10 may include a force mechanism 76 that provides an additional biasing or urging force to print media contact surface 68. Force mechanism 76 is insertable into a cavity or recess 78 in bottom 80 of print media width adjuster 16. In the embodiment shown in FIG. 2, force mechanism 76 is formed of stamped metal which is bent into the shape shown and includes a lip 82 for controlling the depth of insertion of force mechanism 76 within recess 78 of adjuster 16. Lip 82 also engages width adjuster 16 to help anchor mechanism 76 in place. It is to be understood, however, that in other embodiments of the print media alignment apparatus of the present invention, force mechanism 76 may have a different shape and/or be made of different materials. It is also be to understood that force mechanism 76 may be removed.

As shown in FIG. 2, print media alignment apparatus 10 includes a force mechanism 84 operatively coupled to second member 54 to urge print media contact surface 70 against print media stack 14. As also shown in FIG. 2, force mechanism 84 may be a leaf spring made of metal having a first portion 86 insertable in recess 78 of print media width adjuster 16. A lip 88 of first portion 86 controls the depth of insertion of force mechanism 84 into recess 78. Force mechanism 84 also includes an arm 90 that couples to member 54 via a lip 92. The amount of force provided by mechanism 84 can be controlled by the length of arm 90 as well as the material from which it is constructed. As with force mechanism 76, force mechanism 84 may be formed differently than as shown in FIG. 2 and may be made from different materials than metal.

Figure 3:
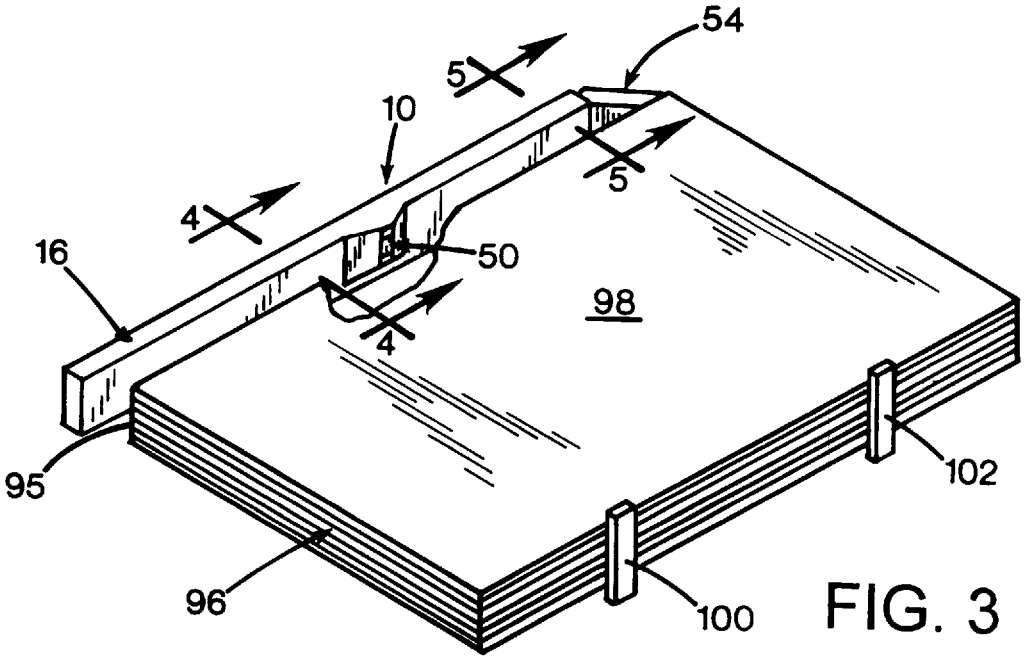
FIG. 3 is a top, perspective view of a print media alignment apparatus of the present invention against an edge of a print media stack so as to align the print media stack against two print media input tray datums.
Figure 4:
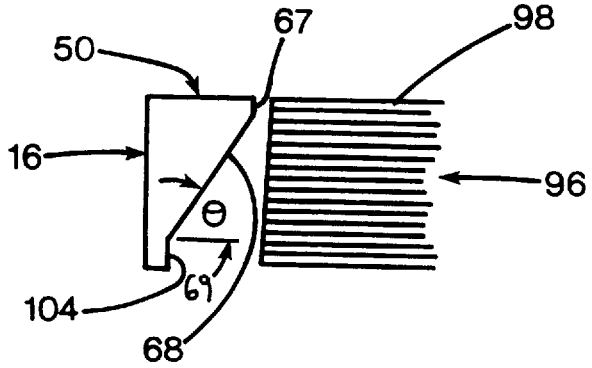
FIG. 4 is a view taken along line 4—4 of FIG. 3.

A top perspective view of apparatus 10 and width adjuster 16 against an edge 95 of a print media stack 96 is shown in FIG. 3. Print media stack 96 includes a plurality of print media sheets, including top sheet 98, and is biased or urged against a pair of datums 100 and 102 by apparatus 10 as shown in FIG. 3. A view of first member 50 taken along line 4—4 of FIG. 3 is shown in FIG. 4. As can be seen in FIG. 4, print media contact surface 68 is configured to slope at an acute angle theta (Θ) with respect to a plane defined by print media stack 96. This plane is represented by line 69 extending from member 50 in FIG. 4. This slope is designed to provide a varying force to stack 96 dependent upon the height of print media stack 96. As can also be seen in FIG. 4, first and second angled portions shown in FIG. 2, are formed to define additional respective second and third print media contact surfaces 104 and 67 configured to be perpendicular to the plane defined by print media stack 96, which is represented by line 69, and to lie adjacent print media contact surface 68. It should be noted that the use of the word perpendicular in this document is specifically defined to mean substantially perpendicular so as to account for things such as engineering and manufacturing tolerances, as well as variations not affecting performance of the present invention. Force mechanism 76 may also provide an additional biasing or urging force to print media contact surfaces 67 and 104 which contact print media stack 96 at different heights as shown in FIG. 3.

Figure 5:
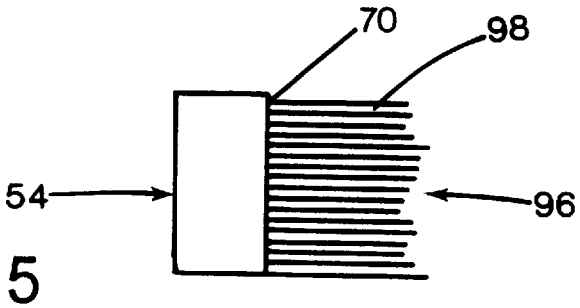
FIG. 5 is a view taken along line 5—5 of FIG. 3.

FIG. 5 shows a side view of second member 54 taken along line 5—5 of FIG. 3. As can be seen in FIG. 5, print media contact surface 70 is configured to be perpendicular to the plane defined by print media stack 96, which is represented by line 69. This angle helps insure that surface 70 contacts print media stack 96 at all heights, including those where only a single print media sheet is present. This shape also helps ensure that the bias force applied by member 70 is constant irrespective of print media stack height. It should be noted that the use of the word constant in this document is specifically defined to mean substantially constant so as to account for things such as engineering and manufacturing tolerances, as well as variations not affecting performance of the present invention.

Figure 6:
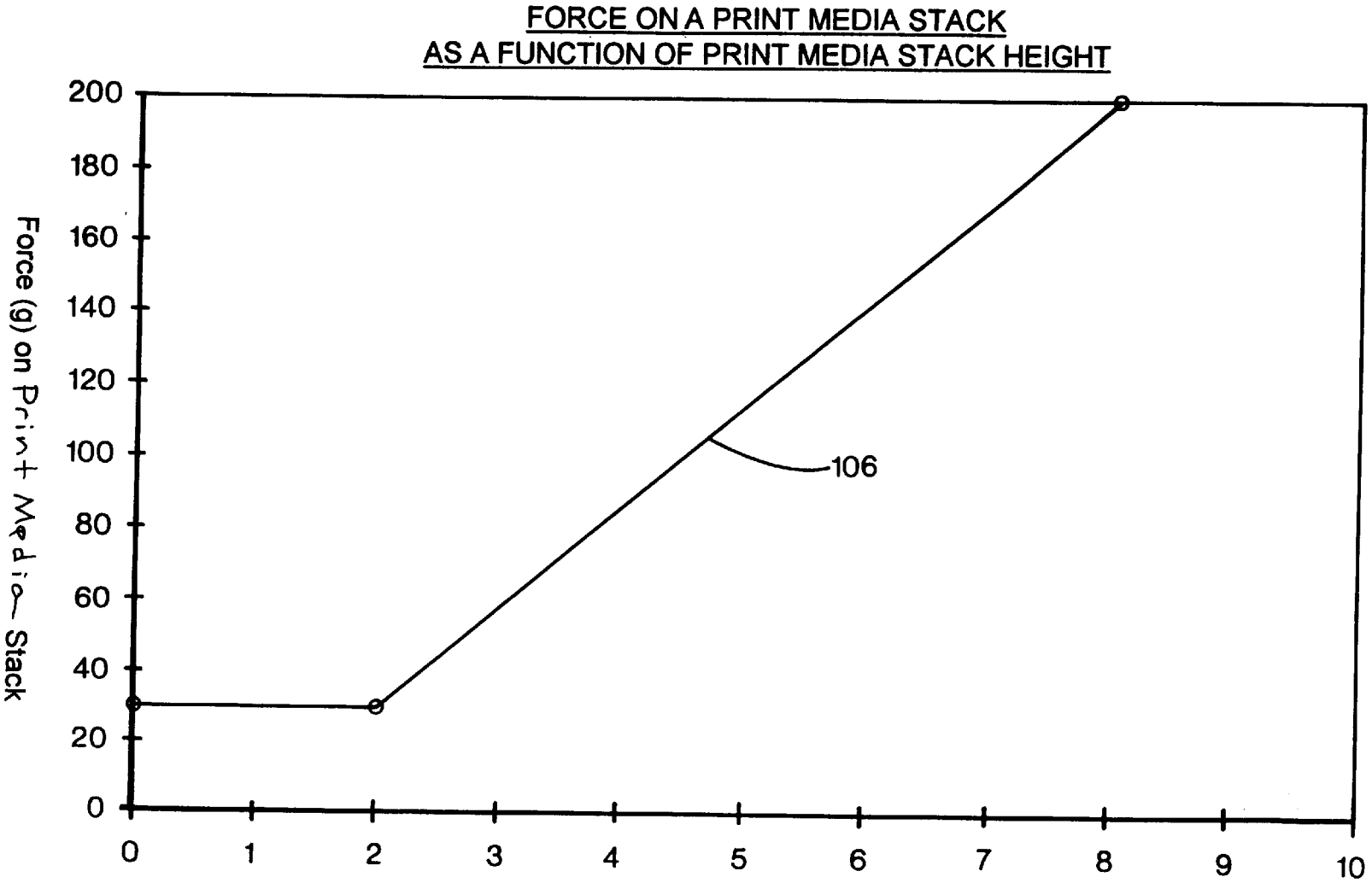
FIG. 6 is a graph of force on a print media stack as a function of print media stack height.

A graph 106 of force on print media stack 96 as a function of stack height is shown in FIG. 6. This force is the combination of forces provided by first member 50 and second member 54. As can be seen from inspection of graph 106, print media contact surface 104 of first member 50 provides no or only a nominal force to print media stack 96. For print media stack heights between approximately zero and 2 millimeters, only print media contact surface 70 of second member 54 exerts a force on print media stack 96. Any force exerted by surface 104 is negligible. As can be seen from graph 106, the force applied to print media stack 96 by print media contact surface 70 of second member 54 is 30 grams. At and above 2 millimeters, print media contact surface 68 of member 50 engages print media stack 96 and applies a force that linearly increases through stack height ranges from zero grams at 2 millimeters to 170 grams at and above 8 millimeters of print media stack height. Thus, at 8 millimeters, the forces provided by first member 50 and second member 54 are additive, totaling 200 grams at and above approximately 8 millimeters of print media stack height 96. Above 8 millimeters of print media stack height 96, surface 67 of first member 50 continues to provide 170 grams of force which adds with the 30 grams provided by print media contact surface 70 to total 200 grams.

This stepwise force profile of graph 106 provides a constant biasing force against print media stack 96 large enough to bias print media stack 96 against datums 100 and 102, while not causing print media stack 96 to buckle when it only includes a single print media sheet or a few print media sheets. It should be noted that heights denoted by millimeters and force magnitudes denoted by grams in this document are specifically defined to be approximately the numeric quantity given, so as to account for things such as engineering and manufacturing tolerances, as well as variations not affecting performance of the present invention.

Although the invention has been described and illustrated in detail, it is to be clearly understood that the same is intended by way of illustration and example only, and is not to be taken by way of limitation. For example, the force applied by member 50 may vary nonlinerly over the print media stack height. As another example surface 104 of member 50 may be configured to exert a force on print media stack 96 that is greater than merely a negligible one. The spirit and scope of the present invention are to be limited only by the terms of the following claims.

What is claimed is:

1. A print media alignment apparatus for use in a printing device, the print media alignment apparatus comprising:

a first member coupled to the printing device, the first member configured to apply a varying force to at least one print media sheet of a print media stack, this force varying from a minimum below a first print media stack height to a maximum at a second print media stack height; and a second member coupled to the printing device, the second member configured to apply a constant force to the print media stack irrespective of print media stack height.

2. The print media alignment apparatus of claim 1, wherein the constant force applied by the second member to the print media stack is less than the maximum force applied by the first member to the print media stack at the second print media stack height.

3. The print media alignment apparatus of claim 1, wherein the constant force applied by the second member to the print media stack is greater than the minimum force applied by the first member.

4. The print media alignment apparatus of claim 1, wherein the varying force applied by the first member decreases as the print media stack height decreases.

5. The print media alignment apparatus of claim 4, wherein the varying force applied to the print media stack by the first member varies linearly between the first print media stack height and the second print media stack height.

6. The print media alignment apparatus of claim 4, wherein the varying force applied to the print media stack by the first member varies in a stepwise manner from a minimum force below the first print media stack height to the maximum force at the second print media stack height.

7. The print media alignment apparatus of claim 1, wherein the first member includes a wall having a print media contact surface configured to contact the print media stack at and above the first print media stack height.

8. The print media alignment apparatus of claim 7, wherein the first member further includes a force mechanism that biases the print media contact surface against the print media stack.

9. The print media alignment apparatus of claim 1, wherein the second member includes a wall having a print media contact surface configured to contact the print media stack at all heights of the print media stack.

10. The print media alignment apparatus of claim 9, wherein the second member further includes a force mechanism that biases the print media contact surface against the print media stack.

11. The print media alignment apparatus of claim 1, wherein the first print media stack height is 2 millimeters, the second print media stack height is 8 millimeters, the maximum of the varying force applied by the first member is 170 grams, and the constant force applied by the second member is 30 grams.

12. A print media alignment apparatus for use in a printing device, the print media alignment apparatus comprising:

a print media width adjuster coupled to the printing device, the print media width adjuster configured to be moveable adjacent a print media stack having at least one sheet of print media, the print media stack defining a plane;

a wall on the print media width adjuster, the wall including a wall first print media contact surface configured to slope at an angle with respect to the plane; and a member movably attached to the print media width adjuster, the member including a member print media contact surface configured to be perpendicular to the plane.

13. The print media alignment apparatus of claim 12, wherein the wall first print media contact surface is further configured to contact at least one sheet of the print media stack at and above a predetermined print media stack height.

14. The print media alignment apparatus of claim 13, wherein the member print media contact surface is configured to contact the print media stack at all print media stack heights.

15. The print media alignment apparatus of claim 13, wherein the predetermined print media stack height is 2 millimeters.

16. The print media alignment apparatus of claim 12, wherein the wall further includes a wall second print media contact surface configured to be perpendicular to the plane and to lie adjacent the wall first print media contact surface.

17. The print media alignment apparatus of claim 16, wherein the wall further includes a wall third print media contact surface configured to be perpendicular to the plane and to lie adjacent the wall first print media contact surface.

18. The print media alignment apparatus of claim 12, further comprising a force mechanism operatively coupled to the member to urge the member print media contact surface against the print media stack.

19. The print media alignment apparatus of claim 18, wherein the member is pivotally attached to the print media width adjuster and the force mechanism includes a spring.

20. The print media alignment apparatus of claim 12, further comprising a force mechanism adjacent the wall, the force mechanism providing a bias force to the wall first print media contact surface.

21. The print media alignment apparatus of claim 12, wherein the wall first print media contact surface is configured to slope at an acute angle with respect to the plane.

22. A method of aligning print media for use in a printing device, the print media having at least one sheet, the method comprising the steps of:

applying a varying first force to at least one sheet of print media at and above a first print media stack height; and applying a second constant force to the print media irrespective of the print media stack height;

wherein the varying first force and the constant second force facilitate uniform alignment of the print media.

23. A print media alignment apparatus for use in a printing device, the print media alignment apparatus comprising:

a print media width adjuster coupled to the printing device, the print media width adjuster configured to be moveable adjacent a print media stack having at least one sheet of print media, the print media stack defining a plane;

a wall on the print media width adjuster, the wall including a wall first print media contact surface configured to slope at an angle with respect to the plane; and a member attached to the print media width adjuster, the member including a member print media contact surface configured to be perpendicular to the plane;

wherein the wall first print media contact surface is further configured to contact at least one sheet of the print media stack at and above a predetermined print media stack height; and further wherein the predetermined print media stack height is 2 millimeters.

24. A print media alignment apparatus for use in a printing device, the print media alignment apparatus comprising:

a print media width adjuster coupled to the printing device, the print media width adjuster configured to be moveable adjacent a print media stack having at least one sheet of print media, the print media stack defining a plane;

a wall on the print media width adjuster, the wall including a wall first print media contact surface configured to slope at an angle with respect to the plane;

a member attached to the print media width adjuster, the member including a member print media contact surface configured to be perpendicular to the plane; and a force mechanism operatively coupled to the member to urge the member print media contact surface against the print media stack.

25. The print media alignment apparatus of claim 24, wherein the member is pivotally attached to the print media width adjuster and the force mechanism includes a spring.

26. A print media alignment apparatus for use in a printing device, the print media alignment apparatus comprising:

a print media width adjuster coupled to the printing device, the print media width adjuster configured to be moveable adjacent a print media stack having at least one sheet of print media, the print media stack defining a plane;

a wall on the print media width adjuster, the wall including a wall first print media contact surface configured to slope at an angle with respect to the plane;

a member attached to the print media width adjuster, the member including a member print media contact surface configured to be perpendicular to the plane; and a force mechanism adjacent the wall, the force mechanism providing a bias force to the wall first print media contact surface.

* * * * *